United States Patent [19]

Odom

[11] Patent Number: 4,665,565

[45] Date of Patent: May 19, 1987

[54] GOLF GLOVE

[76] Inventor: Terrance J. Odom, 2879 Chancery Ct., Rochester, Mich. 48064

[21] Appl. No.: 853,145

[22] Filed: Apr. 17, 1986

[51] Int. Cl.[4] ..... A41D 19/00

[52] U.S. Cl. ..... 2/161 A; 2/159; 2/161 R

[58] Field of Search ..... 2/161 A, 159, 161 R, 2/DIG. 6

[56] References Cited

U.S. PATENT DOCUMENTS

| | | | |
|---|---|---|---|
| 3,274,616 | 9/1966 | Russo | 2/161 |
| 3,348,238 | 10/1967 | Hydock | 2/161 A |
| 3,368,811 | 2/1968 | Finney | 2/159 |
| 3,532,344 | 10/1970 | Masstab | 2/161 A |
| 3,559,212 | 6/1969 | Skovron | 2/161 |
| 3,918,097 | 11/1975 | Mlodoch | 2/161 |
| 3,931,647 | 1/1976 | Dien | 2/161 |
| 4,051,552 | 10/1977 | Widdemer | 2/161 |
| 4,057,255 | 11/1977 | Bishop | 2/161 A |
| 4,504,980 | 3/1985 | Butcher | 2/161 A |
| 4,587,673 | 5/1986 | Boliard | 2/161 A |

FOREIGN PATENT DOCUMENTS

| | | |
|---|---|---|
| 1041251 | 10/1978 | Canada . |
| 1023779 | 3/1966 | United Kingdom . |
| 1252680 | 11/1971 | United Kingdom . |
| 1531399 | 11/1978 | United Kingdom . |

OTHER PUBLICATIONS

Gershman, "Journal of A.M.A.", vol. 168, No. 7, p. 980, 10-1958.

*Primary Examiner*—Werner H. Schroeder
*Assistant Examiner*—Mary A. Ellis
*Attorney, Agent, or Firm*—Gifford, Groh, VanOphem, Sheridan, Sprinkle and Dolgorukov

[57] ABSTRACT

A pair of golf gloves each having loop and pile fastener strips attached to the outer ends of the last three fingers (middle, ring and small finger) and a cooperating loop and pile fastener strip attached to the palm of the golf glove running diagonal across the palm of the hand commencing adjacent to the thumb and running diagonal to the outer midpoint of the heel of the palm so that, when the golfer assumes the grip, the cooperating fastener strips engage each other and firmly lock each contact point in each hand of the golfer's grip to the corresponding contact point of the opposite hand. Each glove further includes loop and pile fastener strips on the back side of both the thumb and the first/second finger junction. When the golf grip is properly taken around the club handle, the fastener strips on the ends of the fingers of the power hand and little finger of one glove engage the fastener strip on the back of the first-/second finger junction on the other glove and, similarly, the fastener strip on the palm of one glove engages the fastener strip on the back of the thumb on the other glove thereby detachably locking the gloves together.

2 Claims, 6 Drawing Figures

GOLF GLOVE

BACKGROUND OF THE INVENTION

I. Field of the Invention

The present invention relates generally to sports and work gloves and, more particularly, where an interlocking grip, or interlocking union of the glove and sports implement (golf club, racket, ski pole, etc.) or work implement (hammer, rake, etc.) promote more efficient skill of the user in use of the implement and especially to a pair of interlocking golf gloves.

II. Description of the Prior Art

In the game of golf, it is essential for proper play that the golf club be firmly gripped throughout the entire golf swing. There is, however, a tendency for many golfers to slightly release or "let go" of the golf club during the back swing so that the golf club slides and/or rotates slightly. When this occurs, the golf club assumes an improper orientation during the downswing which usually results in a poor golf shot.

In order to enhance the golfer's grip on the club, many golfers use one or two golf gloves. Even though golf gloves do enhance the golfer's grip on the club, many golfers still tend to release the golf club during the backswing of the golf stroke.

There have, however, been a number of previously known golf gloves which use loop and pile fasteners having cooperating fastener strips which engage each other when a golf club is properly gripped. These previously known golf gloves, however, have not included any means for locking the golfer's right and left hands together onto the club and thus have not proven totally effective in use.

SUMMARY OF THE PRESENT INVENTION

The present invention provides a pair of interlocking golf gloves which overcomes all of the above-mentioned disadvantages of the previously known devices.

In brief, each golf glove of the present invention comprises a main portion having a thumb and four glove fingers extending outwardly from the main portion. The left and right hand gloves are mirror images of each other and the gloves are positioned over the golfer's hands in the conventional fashion.

The golf glove of the present invention further comprises a loop and pile fastener having at least two cooperating fastener strips, i.e. one loop fastener strip and one pile fastener strip. Such loop and pile fasteners are available under the trademark "Velcro".

One strip of a loop and pile fastener is secured to the outer end of the middle finger and a similar fastener strip is secured to the outer end of the ring finger of the golf glove. A cooperating fastener strip is secured to the palm of the glove adjacent the inner end of the thumb. Thus, when the golf club is gripped in the correct fashion, the fastener strips on the ring and middle fingers engage the cooperating fastener strip on the glove palm thereby securely locking the glove, and thus the golfer's hand, around the golf club grip.

Each golf glove includes fastener strips on the back side of both the thumb and the index finger. When the golf club is properly gripped, the fastener strips on the ends of the middle and ring finger of one glove engage the fastener strips on the back of the index finger on the other glove and, similarly, the fastener strip on the palm of one glove engages the fastener strip on the back of the thumb on the other glove, thereby locking the gloves together aroung the golf club. Furthermore, the fastener strips on both gloves cooperate with each other for both right and left handed golfers.

In a modified form of the invention, one fastener strip is attached directly to the grip on the golf club while the cooperating fastener strip is secured to the palm and fingers of the golf glove. Thus, when the golf club is gripped, the cooperating fastener strips lock the golf glove and the golf club together in the desired fashion.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
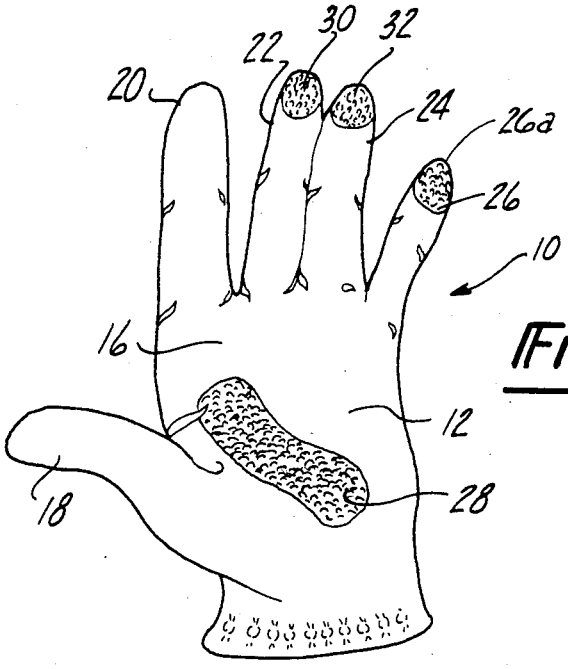
FIG. 1 is a plan view illustrating the palm side of a preferred embodiment of the invention.
Figure 2:
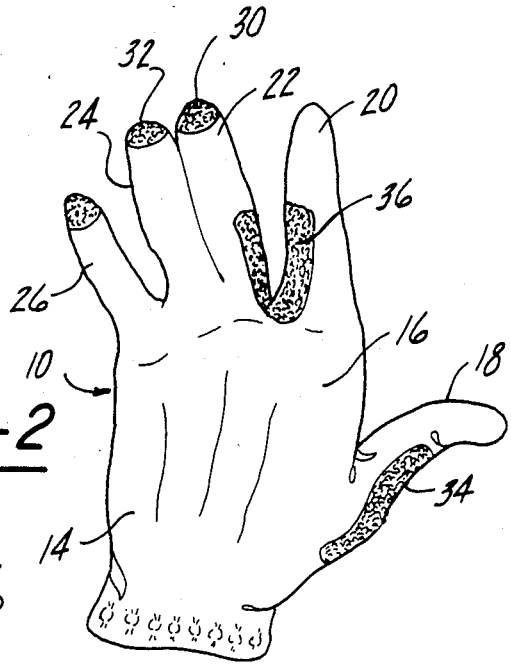
FIG. 2 is a plan view illustrating the back side of a preferred embodiment of the invention.

With reference now to FIGS. 1 and 2, a preferred embodiment of the pair of golf gloves 10 (only one illustrated) in the present invention is thereshown. The golf glove 10 includes a palm side 12, illustrated in FIG. 1, and a back side 14, illustrated in FIG. 2. In addition, the left and right hand gloves 10 and 10' are mirror images of each so that only the left glove will be described in detail, it being understood that a like description shall also apply to the right glove.

The golf glove 10 comprises a main glove portion 16 into which the golfer's hand is inserted. A glove thumb 18, index glove finger 20, middle glove finger 22, ring glove finger 24 and little glove finger 26 extend outwardly from the main portion 16 and are adapted to receive the thumb, index finger, middle finger, ring finger and little finger, respectively, of a golfer's hand in the conventional fashion.

As best shown in FIG. 1, a fastener strip 28 of a loop and pile fastener is secured to the palm side 12 of the main glove portion 16 adjacent the inner end of the glove thumb 18. Three fastener strips 30, 32 and **26*a* are attached to both the middle, ring and little glove fingers 22, 24 and 26, respectively, adjacent their outer ends and preferably extend around the ends of the middle glove finger 22, ring glove finger 24 and little finger 26 as best shown in FIG. 2**.

With reference now particularly to FIG. 2, a fastener strip 34 is secured along the middle of the back side of the glove thumb 18. Similarly, a fastener strip 36 is secured along the back side of the first/second finger junction 20 and 30. The fastener strip 36 preferably also extends along the back side of the middle glove finger 22 so that the fastener strip 36 is generally V-shaped.

The fastener strips 30, 32, **26*a* and 34 are all of the same type, i.e. pile. Similarly, the fastener strips 28 and 36** are both of the other type, i.e. loop.

Figure 3:
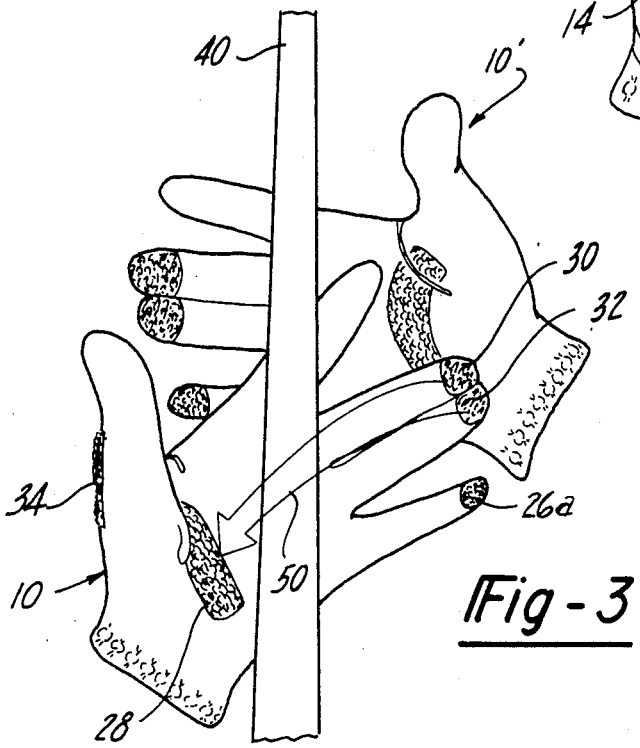
FIGS. 3 and 4 are elevational views illustrating the operation of a preferred embodiment of the invention.

With reference now to FIG. 3, in practice one glove 10 is positioned over the golfer's left hand while another glove 10' is positioned over the golfer's right hand. As previously described, the left and right hand gloves 10 and 10' are mirror images of each other.

Assuming that the golfer is a right hand golfer, the golfer's left hand is positioned around the golf club 40 so that the fastener strips 30, 32 and 26*a* engage the fastener strip 28 (which is of the opposite type) on the golfer's left glove 10 as illustrated by arrow 50. In doing so, the fastener strips 30, 32 and 26*a* detachably lock against the fastener strip 28 thereby firmly securing the golfer's selected grip as well as his or her hand around the golf club 40 in the desired fashion.

Figure 4:
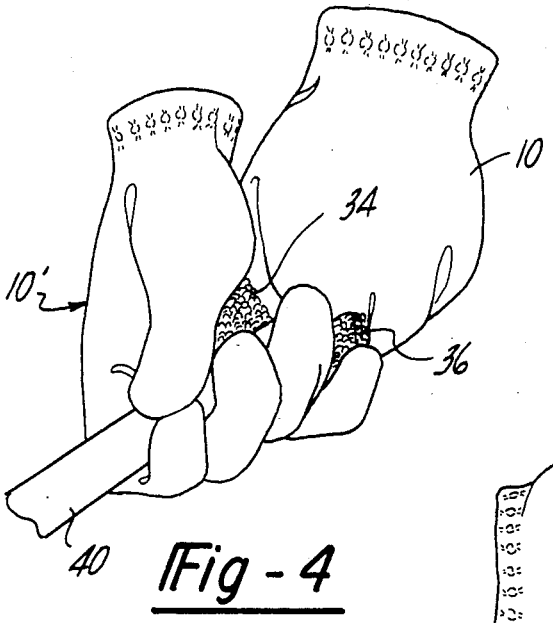

Thereafter, the golfer's right hand is positioned around the golf club as shown in FIG. 4. In doing so, and assuming that the golfer has selected a proper grip of the golf club, the fastener strips 26*a* on the golfer's right glove 10' engage the fastener strip 36 (which is of the opposite type) on the golfer's left glove 10. Simultaneously, the fastener strip 28 on the golfer's right glove engages the fastener strip 34 on the golfer's left glove thereby firmly, but detachably, interlocking the golfer's right and left hands together and around the golf club in the selected fashion.

For left handed golfers, the above process is simply reversed.

In practice, it has been found that the golf gloves of the present invention simply, easily and also effectively lock the golfer's hands, both together and around the golf club and completely eliminate any release of the golf club during the golf swing.

Figure 5:
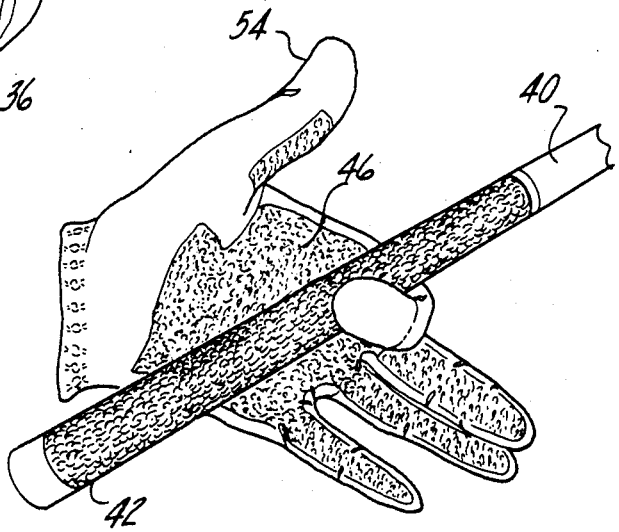
FIGS. 5 and 6 are elevational views illustrating a second preferred embodiment of the invention.
Figure 6:
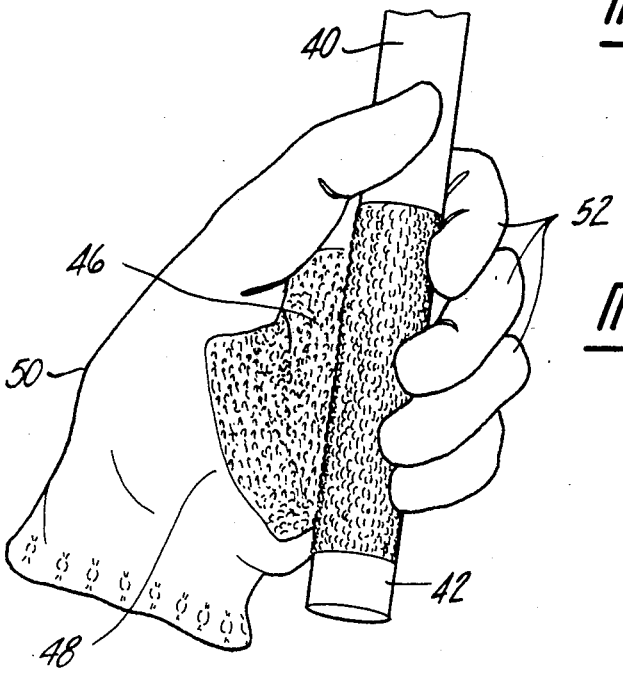

With reference now to FIGS. 5 and 6, a modified form of the present invention is thereshown in which the golf club 40 includes a golf club grip 42 having a loop fastener strip 44 attached around the entire part of its outer periphery. A cooperating fastener (pile) 46 is attached to the palm 48 of a golf glove 50 so that, when the golf club 40 is gripped by the golfer, the palm fastener (pile) 44 and 46 mesh thereby securely, but detachably, locking the golf glove 50 to the golf club grip 42. Preferably, the fastener strip 46 also extends along the palm side of the middle, ring and little fingers 52 and thumb 54 thus enhancing the locking action between the golf glove and the golf grip 42.

The glove in the modified form of the invention illustrated in FIGS. 5 and 6 can also be used for sports and work functions other than golf.

From the foregoing, it can be seen that the present invention provides a golf glove which simply but effectively locks the golf glove around the golf club and also locks the golfer's right hand glove to the left hand glove. In doing so, the present invention completely eliminates any release of the golf club during the golf swing.

Having described my invention, however, many modifications thereto will become apparent to those skilled in the art to which it pertains without deviation from the spirit of the invention as defined by the scope of the appended claims.

I claim:

1. A left and right pair of golf gloves, each glove comprising a glove thumb, an index glove finger, a middle glove finger, a ring glove finger, a little glove finger, a main glove portion having a palm side and a back side, said glove thumb and said glove fingers extending outwardly from said main portion and said glove thumb and said glove fingers each having a palm side and a back side, means for securing a pair of first fastener strips to an outer end of said middle and said ring glove fingers, means for securing a second fastener strip to the palm side of said main glove portion adjacent an inner end of said glove thumb, means for securing a third fastener strip to the back side of said glove thumb, and means for securing a fourth fastener strip to the back side of said index finger, wherein said first and said fourth fastener strips on opposite gloves together comprise a loop and pile fastener and wherein said second and third fastener strips on opposite gloves together comprise a loop and pile fastener, wherein said second fastener strip and said fourth fastener strip comprise one of a loop fastener strip and a pile fastener strip while said first fastener strip and said third fastener strip comprise the other of said loop fastener strip and said pile fastener strip, whereby when said golf gloves grip a golf club, said first fastener strips of one glove engage said fourth fastener strip on the other glove and said second fastener strip on said one glove engages the third fastener strip on the other glove.

2. The invention as defined in claim 1 wherein said means for securing said fourth fastener strip to the back side of the index glove finger further comprises means for securing said fourth fastener strip to the back side of the middle glove finger.

* * * * *